US005412879A

United States Patent [19]

Wu

[11] Patent Number: 5,412,879

[45] Date of Patent: May 9, 1995

[54] HAIR DRYER HANDLE STRUCTURE

[76] Inventor: Otto Wu, Room 918, 15 Fu Hsing N. Road, Taipei, Taiwan, Prov. of China

[21] Appl. No.: 156,729

[22] Filed: Nov. 24, 1993

[51] Int. Cl.[6] ..... A45D 20/00

[52] U.S. Cl. ..... 34/97; 392/384

[58] Field of Search ..... 34/96, 97, 98, 99, 100, 34/101, 283; 392/379, 380, 381, 382, 383, 384, 385

[56] References Cited

U.S. PATENT DOCUMENTS

| | | | |
|---|---|---|---|
| 3,949,487 | 4/1976 | Bartram et al. | 34/99 |
| 4,528,440 | 7/1985 | Ishihara | 392/385 |
| 4,556,782 | 12/1985 | Fujishima et al. | 34/96 |
| 4,701,595 | 10/1987 | Okutsu et al. | 34/97 |
| 4,924,602 | 5/1990 | Ohlsen | 34/97 |

*Primary Examiner*—Denise L. Gromada
*Attorney, Agent, or Firm*—Bacon & Thomas

[57] ABSTRACT

A hair dryer includes a handle and an air blower housing with an elongated barrel extending therefrom. The handle has an elongated cord support member extending from the lower end thereof and substantially parallel with the barrel to define a pair of opposite and separated arms to allow the cord to be wound thereon. The cord support member has a corrugated surface defined by a number of troughs and ridges alternating with each other to allow the windings of the electrical cord to be respectively located within the troughs for a more even or regular winding of the electrical cord between the support member and the barrel. A hang hook is formed on the remote end of the support member to allow the hair dryer to be hung on a fixed hanger.

2 Claims, 3 Drawing Sheets

HAIR DRYER HANDLE STRUCTURE

FIELD OF THE INVENTION

The invention relates generally to a hair dryer and in particular to a handle structure of the hair dryer which allows the electrical cord to be wound thereon in a more regular manner and thus avoid tangling of the cord.

BACKGROUND OF THE INVENTION

Hair dryers have been a useful hair grooming implement for both home and beauty salon use. An example of the currently commercially available hair dryers is shown in FIG. 4 of the accompanying drawings. The conventional hair dryer, designated by the reference numeral 50 in FIG. 4, usually comprises an air blower (not shown) housed within a housing 32 having an elongated barrel 30 extending from the housing 32 to conduct an air flow that is heated by heating means (not shown) disposed inside the hair dryer 50 from housing 32 and out through a front opening 34 of barrel 30.

Conventionally, the hair dryer 50 also has a handle 40 fixed to the housing 32. An electrical cord 41 extends out of the hair dryer 50 from a lower end of the handle 40 to provide an electrical connection with an external power source (not shown) with an electrical plug 42 mounted to the remote end thereof.

Generally, before the hair dryer is stored in, for example, a drawer, the user will wind the electrical cord on the handle 40 and/or the barrel 30 and such a winding is usually quite irregular due to the fact that there is no means to help the user to arrange the electrical cord on the handle or the barrel in a regular way. The irregularity of the winding of the electrical cord on the handle or the barrel of the hair dryer sometimes leads to tangling of the electrical cord. This certainly causes problems in unwinding the cord from the hair dryer before the next use.

It is therefore desirable to provide a hair dryer having such a handle structure that helps the user to arrange the cord on the hair dryer in a more regular way and thus overcome the above-mentioned problem.

SUMMARY OF THE INVENTION

The principal objective of the present invention is to provide a hair dryer having such a handle structure that allows the user to arrange the electrical cord on the hair dryer in a more regular way.

According to an aspect of the present invention, there is provided a hair dryer handle structure comprising a cord support member extending from the handle and substantially parallel with the barrel of the hair dryer so as to form a pair of spaced opposed arms to allow the cord to be wound around the arms, a corrugated surface formed on the support member and having a number of troughs to respectively receive the windings of the cord therein so as to avoid tangling of the cord when wound on the hair dryer.

According to another aspect of the present invention, there is provided a hair dryer handle structure comprising a hang hook formed on the remote end of the cord support member by bending the remote end backwards so as to allow the hair dryer to be hung on a fixed hanger.

BRIEF DESCRIPTION OF THE DRAWINGS

Other objectives and advantages of the invention will be apparent from the following description of a preferred embodiment of the present invention taken in connection with the accompanying drawings wherein.

DETAILED DESCRIPTION OF THE PREFERRED EMBODIMENT

Figure 1:
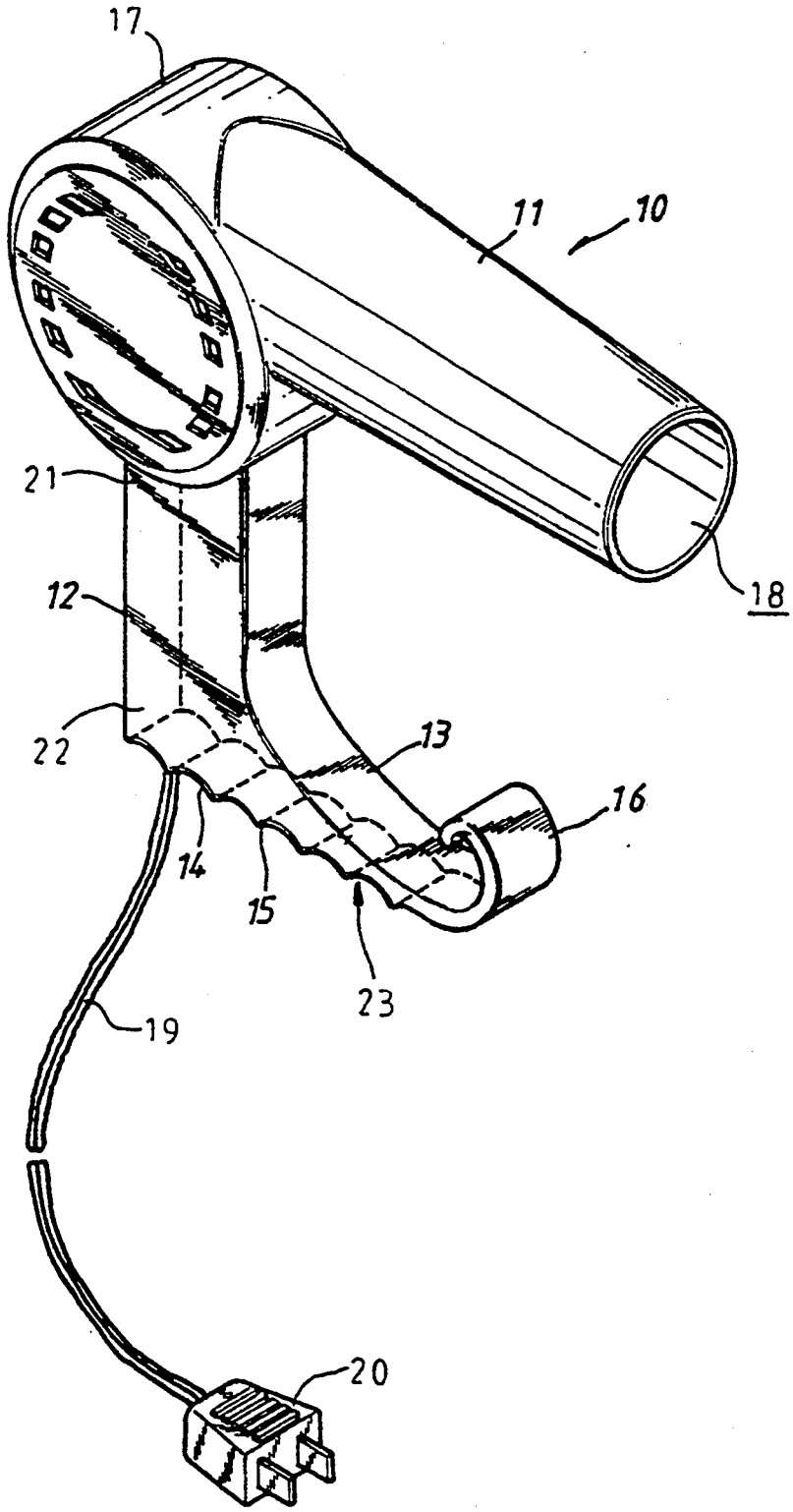
FIG. 1 is a perspective view showing a hair dryer having a handle structure made in accordance with the present invention.

With reference to the drawings and in particular to FIG. 1, wherein a hair dryer, generally designated by the reference numeral 10, is shown. The hair dryer 10 comprises a blower housing 17 from which an elongated barrel 11 extends, and inside which housing 17 and barrel 11 are air blower means and heating means, both not shown, disposed to provide a heated air flow which is conducted by the barrel 11 to flow out of the hair dryer 10 from a front opening 18 of the barrel 11. The structures of the air blower means and the heating means and other necessary parts that are not explicitly listed herein are all familiar to those having ordinary skill and thus will not be further discussed.

The hair dryer 10 also comprises a handle 12 having an upper end 21 on which the air blower housing 17 is securely fixed to allow a user to use the hair dryer 10 by holding the handle 12. The provision of the handle 12 on the hair dryer 10 is also well known, as previously mentioned in the BACKGROUND OF THE INVENTION section, and no further discussion will be given.

As is also known to ordinary people and mentioned previously, the hair dryer 10 has an electrical cord 19 extending from an opposite lower end 22 of the handle 12 with a plug 20 mounted on a remote end thereof to provide an electrical connection with an external power source, such as a wall outlet (not shown).

Figure 2:
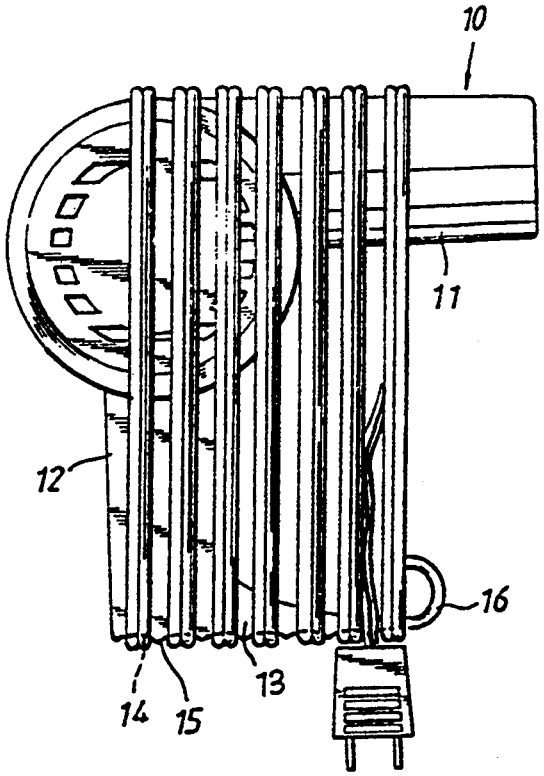
FIG. 2 is a side elevational view showing the electrical cord regularly wound on the hair dryer.

According to an aspect of the present invention, an elongated cord support member 13 is provided on the hair dryer 10, extending from the lower end 22 of the handle 12 and substantially parallel with the barrel 11 so as to form a pair of opposed spaced "arms" with the barrel 11 to allow the electrical cord 19 to be wound around the arms, as shown in FIG. 2.

To allow the electrical cord 19 to be wound on the opposite arms, namely the cord support member 13 and the barrel 11, in a more regular manner, the cord support member 13 is provided with a corrugated surface 23 having a number of troughs 14 alternating with a number of ridges 15. By allowing the windings of the electrical cord 19 to be respectively received and located within the troughs 14, the electrical cord 19 can be arranged on and wound around the cord support member 13 and the barrel 11 in a more regular or even manner, as shown in FIG. 2.

Figure 3:
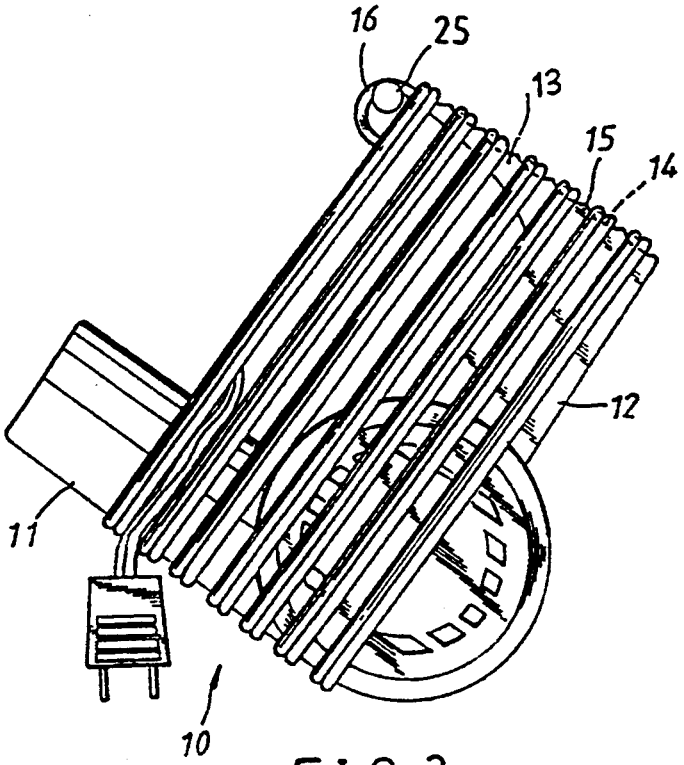
FIG. 3 is also a side elevational view showing the hair dryer hung on a fixed hanger.
Figure 4:
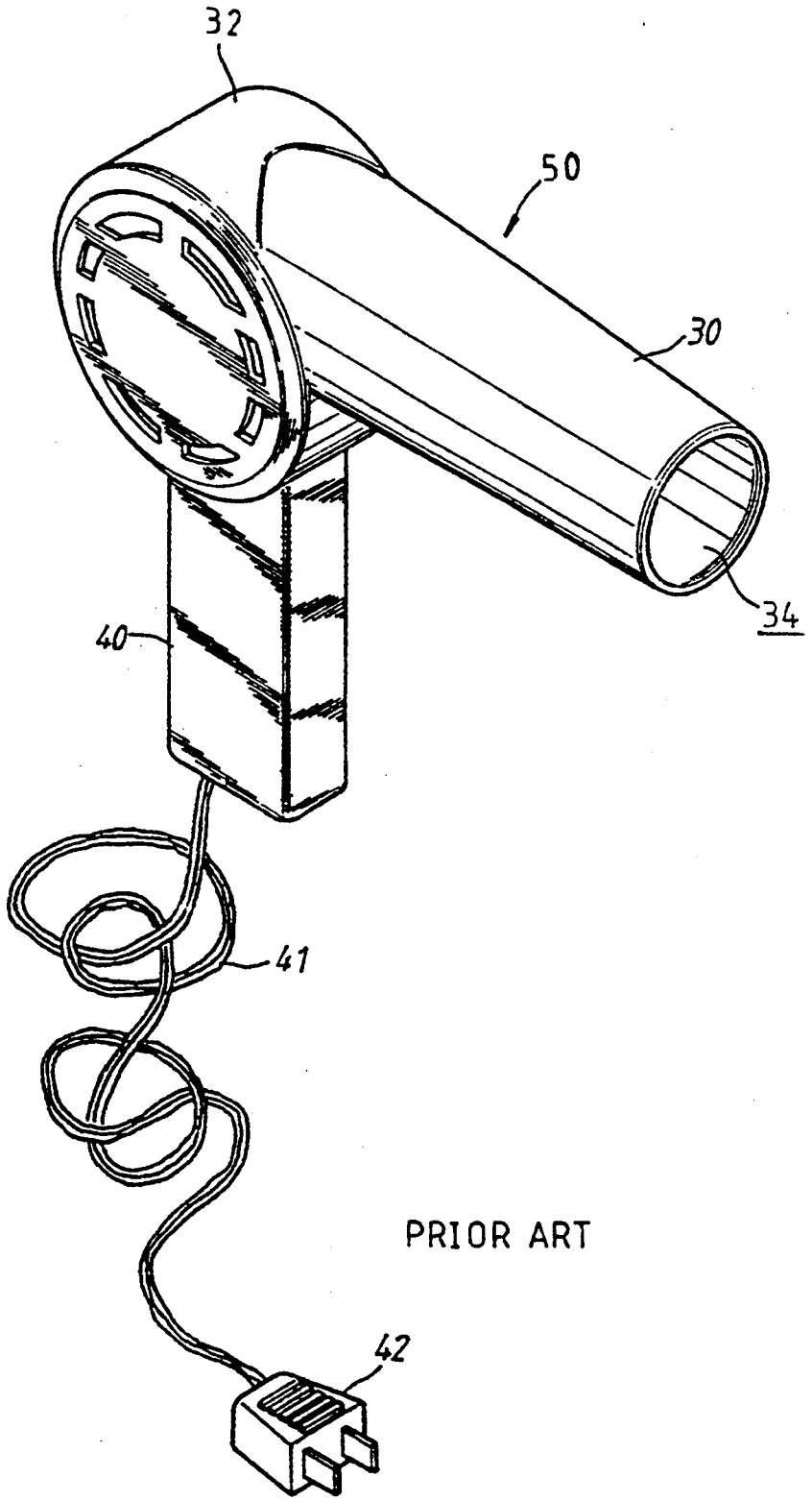
PRIOR ART FIG. 4
FIG. 4 is a perspective view showing a hair dryer that has a conventional handle structure.

According to another aspect of the present invention, a hang hook or hang ring 16 may be formed on an end of the cord support member 13 that is remote from the handle 12 by bending the remote end of the cord support member 13 backward. As shown in FIG. 3, this hang hook 16 allows the hair dryer 10 to be hung on a fixed hanger 25 which may be secured on a fixture (not shown).

It is apparent that although the invention has been described in connection with the preferred embodiment, those skilled in the art may make changes to certain features of the preferred embodiment without departing from the spirit and scope of the invention as defined in the appended claims.

What is claimed is:

1. A hair dryer comprising a housing with an elongated barrel extending forward therefrom, a handle having an upper end with said housing mounted thereon and an electrical cord extending out of said hair dryer from an opposite lower end of said handle, said handle having an elongated cord support member extending from the lower end thereof, the support member being spaced from and substantially parallel with said barrel to allow said electrical cord to be wound around said cord support member and said barrel, and said cord support member comprises a corrugated surface having a number of troughs alternating with a number of ridges to respectively receive the windings of said electrical cord therein.

2. A hair dryer as claimed in claim 1 wherein said cord support member comprises a hang hook formed on an end thereof remote from said handle by bending the remote end thereof backward to allow said hair dryer to be hung on a fixed hanger.

* * * * *